United States Patent [19]

Vaucher

[11] Patent Number: 5,023,849

[45] Date of Patent: Jun. 11, 1991

[54] ASTRONOMIC TIMEPIECE AND DISC INTENDED FOR USE THEREIN

[75] Inventor: Frank Vaucher, Cormoret, Switzerland

[73] Assignee: Compagnie des Montres, Longines, Francillon, S.A., Switzerland

[21] Appl. No.: 435,886

[22] Filed: Nov. 14, 1989

[30] Foreign Application Priority Data

Nov. 15, 1988 [CH] Switzerland ..... 04241/88

[51] Int. Cl.[5] ..... G04B 19/26

[52] U.S. Cl. ..... 368/15; 368/16

[58] Field of Search ..... 368/15-20

[56] References Cited

U.S. PATENT DOCUMENTS

| | | | |
|---|---|---|---|
| 245,130 | 8/1881 | Burmann | 368/18 |
| 372,575 | 11/1887 | Shimp | 368/20 |
| 521,725 | 6/1894 | Molesworth | 368/15 |
| 1,997,511 | 2/1935 | Canera | 368/18 |
| 4,548,512 | 10/1985 | Erard | 368/15 |
| 4,551,027 | 11/1985 | Spruck | 368/15 |
| 4,711,583 | 12/1987 | Oechslin et al. | 368/16 |
| 4,759,002 | 7/1988 | Cash | 368/15 |
| 4,849,949 | 7/1989 | Voth | 368/19 |

FOREIGN PATENT DOCUMENTS

| | | |
|---|---|---|
| 195742 | 9/1986 | European Pat. Off. . |
| 2460725 | 6/1976 | Fed. Rep. of Germany . |
| 348040 | 3/1905 | France . |

*Primary Examiner*—Vit W. Miska

*Attorney, Agent, or Firm*—Pollock, Vande Sande & Priddy

[57] ABSTRACT

The invention concerns an astronomic timepiece enabling a simple display of the daily value of an astronomic magnitude having an annual cycle. The timepiece comprises a month disc (13), at least a portion of which is visible through an opening (19) provided in the dial (6). The development of the astronomic magnitude is represented in the form of a curve (25) in a frame of reference one coordinate of which indicates the date and the other indicates a value of the astronomic magnitude.

11 Claims, 5 Drawing Sheets

ASTRONOMIC TIMEPIECE AND DISC INTENDED FOR USE THEREIN

This invention concerns an astronomic timepiece part indicating the daily value of one or several astronomic magnitudes having an annual cycle such as the time of sunrise or sunset, the declination of a star or the like through an opening provided in the dial. These timepieces are principally intended to be assembled into watches of the wrist watch type.

The invention likewise concerns a disc for the display of astronomic magnitudes.

BACKGROUND OF THE INVENTION

Timepieces are already known, in particular astronomic watches which indicate the values of an astronomic magnitude with daily variation. These values are indicated by means of hands which are displaced by one step per day opposite a graduated scale a predetermined magnitude. However, here we are concerned with watches comprising highly complex movements with planetary gearing having multiple planet wheel sets. These mechanisms are thus of a very compact nature and consequently much too expensive to be manufactured by mass production methods. Furthermore, on such watches, the surface available for the display is relatively small to the extent that the reading of the astronomic values is not particularly easy and thus very often lacks precision.

On the other hand, astronomic watches are known presenting astronomic information through an opening provided in the dial. However, such information concerns astronomic magnitudes having an annual cycle with a constant value over the duration of a given month, for instance a sign of the zodiac. Here again, should one wish to display the value of an astronomic magnitude which varies daily, it is necessary to employ a disc effecting one rotation over 365 days, which likewise presents the difficulties mentioned hereinabove.

The principal purpose of this invention is thus to overcome the difficulties of the prior art by furnishing a timepiece enabling the display of the daily value of an astronomic magnitude having an annual cycle in a simple and precise manner and furthermore for only a small increase in the cost of the timepiece.

SUMMARY OF THE INVENTION

To this effect, the invention has as an object an astronomic timepiece for the indication of at least one astronomic value having an annual cyle varying daily and including a timepiece movement. In conformity with the invention, it comprises a first disc driven by said movement by monthly steps in order to effect one revolution in one year and a dial provided with at least one opening associated with each astronomic magnitude through which a portion of the first disc is visible, said timepiece comprising for each opening first graduations indicating the date or a date, second graduations indicating the value of said astronomic magnitude and a set of curve segments borne by said first disc, said segments cooperating with said graduations in order to indicate at least one daily value of said astronomic magnitude and being arranged in a manner to appear successively in said opening in the course of the rotation of the first disc.

Thus, the development of the value of an astronomic magnitude over the duration of a month may be easily indicated whilst employing a standard month disc without adding supplementary gearing. Furthermore, the energy required for the display of this value is particularly low.

According to an advantageous embodiment of the invention, the timepiece comprises a single opening for each astronomic magnitude, each curve segment associated with this opening representing the successive daily values of said astronomic magnitude over a month. And, preferably, the graduations are borne by the dial and arranged along the sequential edges of the opening.

The invention likewise has as object a disc for the display of an astronomic magnitude including a plurality of display surfaces on each of which figures a curve representative of the daily variation of an astronomic magnitude over the course of a predetermined period.

Other characteristics and advantages of the invention will appear from the description which follows of the non-limiting embodiments of the invention in association with the attached drawings.

DESCRIPTION OF THE PREFERRED EMBODIMENTS

Figure 1:
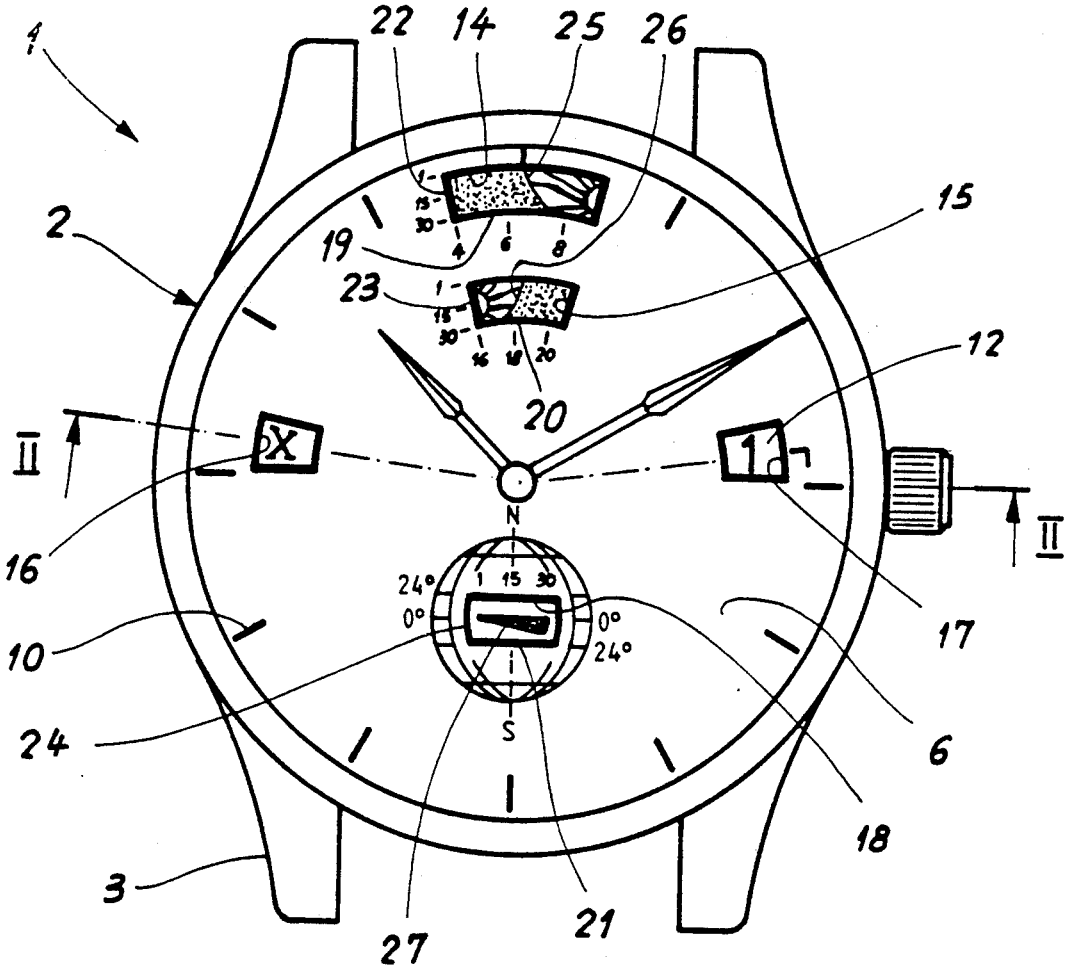
FIG. 1 is a schematic plan view of a wrist watch according to the invention, the bracelet being removed.

Referring initially to FIG. 1, one sees a plan view of a wrist watch designated by the general reference 1. This watch 1, having a generally circular form, comprises, in a well-known manner, a case 2 having bracelet attachement lugs 3. As shown on FIG. 2, the watch also comprises a timepiece movement 4 with a time setting stem and bearing a dial 6 as well as hands which are not referenced. The case 2 includes a caseband 7 to the upper portion of which is secured a crystal 8 and to the lower portion a back cover 9. The back cover 9, fastened to the case 2 in an appropriate manner, for instance by means of screws not shown on the drawing, assures closing of the case 2.

The dial 6 bears the standard time divisions 10 and is traversed furthermore by three concentric axes bearing respectively the hours hand, minutes hand and seconds hand. Furthermore, the watch movement drives step by step a date ring 11 at the rate of one step each 24 hours. This ring, in a known manner, bears on its surface 12 directed towards dial 6 the indication of the 31 days of the month.

Finally, the movement drives step by step a month disc 13 at the rate of one step per month, this disc effecting a complete revolution in one year.

A driving arrangement for the month disc may for instance comprise a finger fixed to the date ring driving once per month an intermediate wheel which cooperates with the month disc associated with a jumper spring assuring the position thereof.

According to the invention, the watch shown on FIG. 1 comprises openings 14, 15, 16, 17, 18 through which a part of the month disc is visible. Each of these openings is associated with an astronomic magnitude having an annual cycle which varies daily.

In the example of FIG. 1, openings 14, 15 and 18 are associated respectively with the time of sunrise, the time of sunset and the solar declination. These openings are arranged in the form of sectors of concentric rings of different diameters. The information concerning the astronomic values borne by the month disc appears through the openings 14, 15 and 18 in the form of segments of curves.

The lower edge 19, 20 of each opening 14, 15 is provided with graduations and constitutes a first axis which one may consider as the abscissa axis. The graduations inscribed along this axis indicate values associated with the astronomic magnitude displayed in the opening, namely the time of sunrise and the time of sunset respectively.

Furthermore, the lateral edge 22, 23 of each opening 14, 15 is also provided with graduations and thus constitutes a second axis which may be considered as the ordinate axis. The graduations borne along this ordinate axis indicate in the case shown, the date values.

On the other hand, the lower or upper edge 21 of opening 18 is provided with graduations indicating the date values and the side edge 24 is provided with graduations indicating the values of an astronomic magnitude, in this case an angular value of the solar declination.

Consequently, the lower edge 19, 20, 21 and the side edge 22, 23, 24 of each opening 14, 15, 18 form a reference framework of the cartesian type in which are inscribed curve segments 25, 26, 27. In this manner, one may easily represent the development of an astronomic magnitude which varies daily in the course of a month and thereby even read directly the daily value of this latter.

It is well understood that the graduations mentioned above can be directly borne by the month disc 13. However, this solution requires naturally the inscription of the graduations opposite each curve segment.

It will likewise be noted that as a function of the arrangement of the openings and of the scale of values employed for the date and the astronomic magnitude, it may occasionally be advantageous to associate the abscissa axis with the values of the date and the ordinate axis with the values of the astronomic magnitude.

Openings 16 and 17 provided in dial 6 in a ring of the same diameter are intended to allow appearance of the indication of the current month and date respectively.

Opening 16 is provided between 9 and 10 o'clock while opening 17 is provided between 2 and 3 o'clock in order that they avoid alignment along the same diameter.

Figure 3:
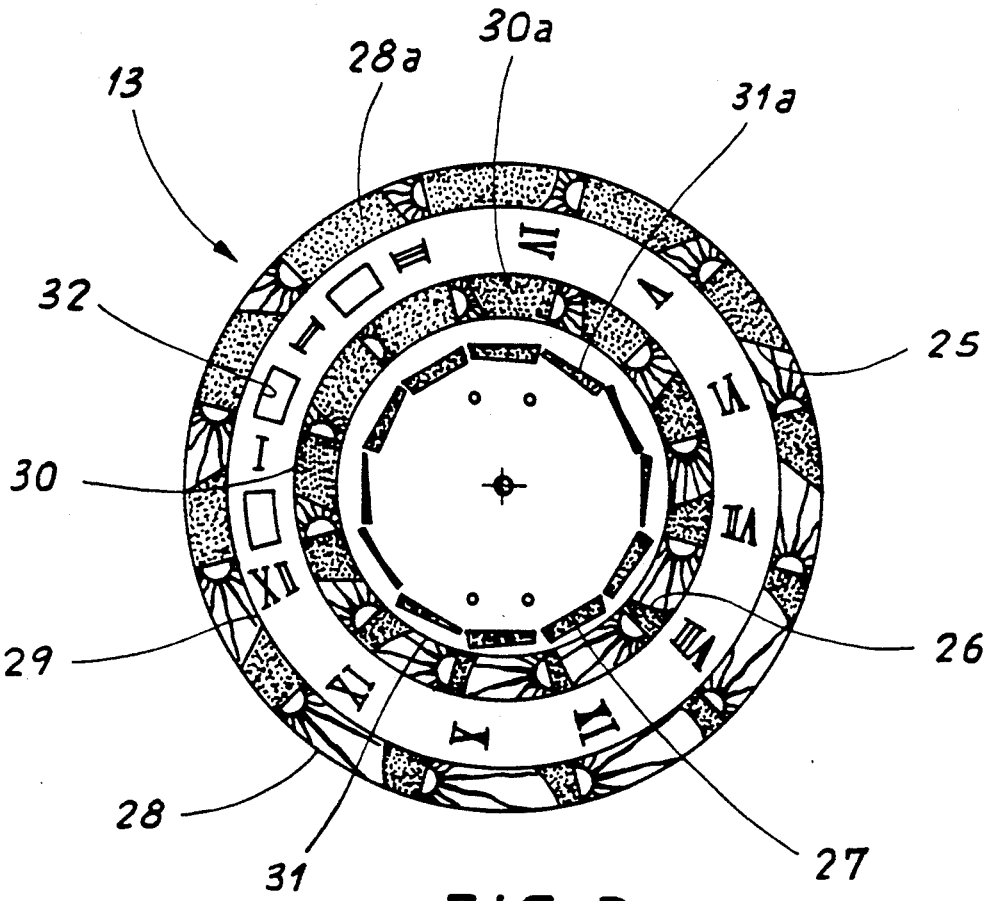
FIG. 3 is a plan view of an example of a month disc for a timepiece according to the invention.

In referring now to FIG. 3, one sees a plan view of a month disc 13 according to the invention. Such month disc 13 comprises on its surface facing the dial a plurality of graphic markings. These markings are arranged on four concentric rings 28, 29, 30, 31 of different diameters corresponding to the diameters of the rings in which the openings 14, 15, 16, 17, 18 are provided. In starting with the ring of greatest diameter, the first 28, the third 30 and the fourth 31 are each associated with an astronomic magnitude while the second 29 indicates month numbering in a well-known manner represented here by roman numbers.

Each ring 28, 30, 31 associated with an astronomic magnitude is divided into twelve sectors **28*a*, 30*a*, 31*a* and on each of them appears a curve segment 25, 26, 27** corresponding to the daily development over the course of one month of the year of the associated astronomic magnitude.

In the example shown the first ring 28 comprises twelve sectors **28*a*, each comprising a curve segment 25, indicating the daily development of the time of sunrise over the course of the twelve months of the year, this ring 28 cooperating with the opening 14 located at 12 o'clock on dial 6**.

The second ring 29 gives the indication of the month, the sign of the present month being visible through the opening 16 provided in the dial. In another respect, this second ring 29 comprises twelve openings 32 respectively provided between each month sign. These openings 32 cooperate on the one hand with a part of the date ring 11 in order that this latter be visible permanently through one of the openings 32, and on the other hand with opening 17 provided in dial 6.

The third ring 30 exhibits information substantially identical to that of the first ring 28, namely the daily evolution of the time of sunset in the form of segments of curve 26. This third ring 30 is visible through an opening 15 likewise provided at 12 o'clock along a diameter less than that of the two preceding rings.

Finally, the fourth ring 31 also divided in twelve sectors **31*a*, indicates in the form of a curve 27 the daily angular values of the solar declination, this curve 27 being visible through an opening 18** provided at 6 o'clock.

It is evident that, should one so desire, these rings may be divided into a greater or lesser number of sectors. In this case, the disc step and the size of the openings, the indications and the associated graduations will require to be adapted.

Figure 4:
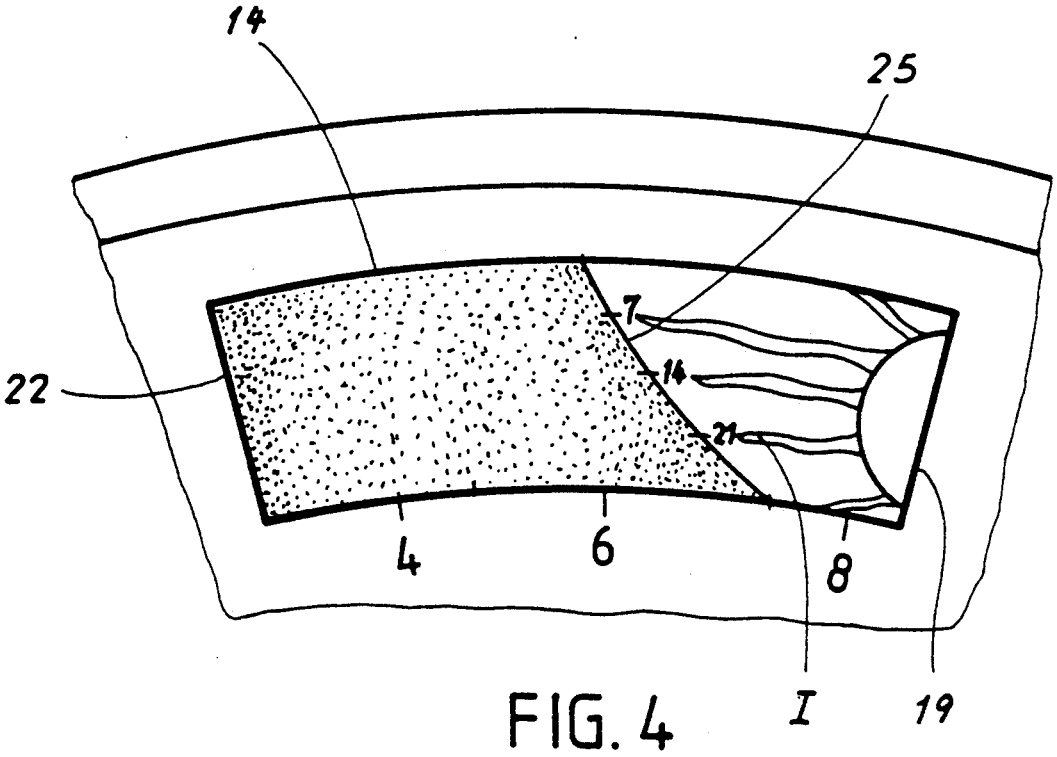
FIGS. 4 to 6 show different embodiments of the display, through an opening of the dial, of astronomic magnitudes which vary daily in accordance with the invention.

In a variant, the lower edge 19 of the opening 14 may indicate the value of the astronomic magnitude while the date may be indicated along each segment 25 of the curve by means of an these latter being provided in an example of graphism shown on FIG. 4 by the ends of the sunrays.

Figure 5:
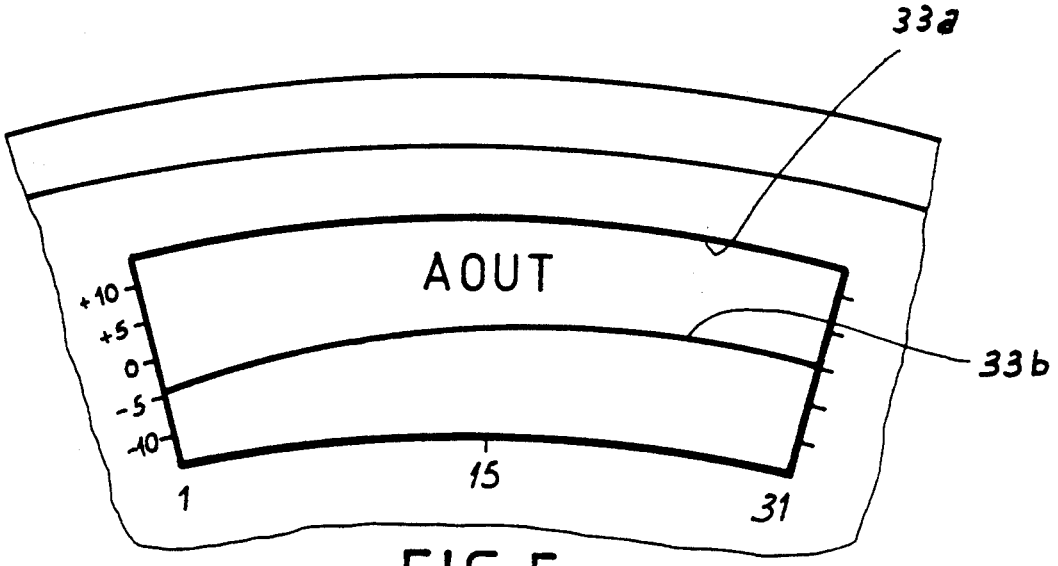

In accordance with another embodiment of the graphic representation shown on FIG. 5, the curve segments associated with each astronomic magnitude appearing in an opening **33*a* may be placed end to end and form a continuous curve 33*b*** extending the length of a ring, this being particularly interesting for the indication of the curve representative of the equation of time.

Figure 6:
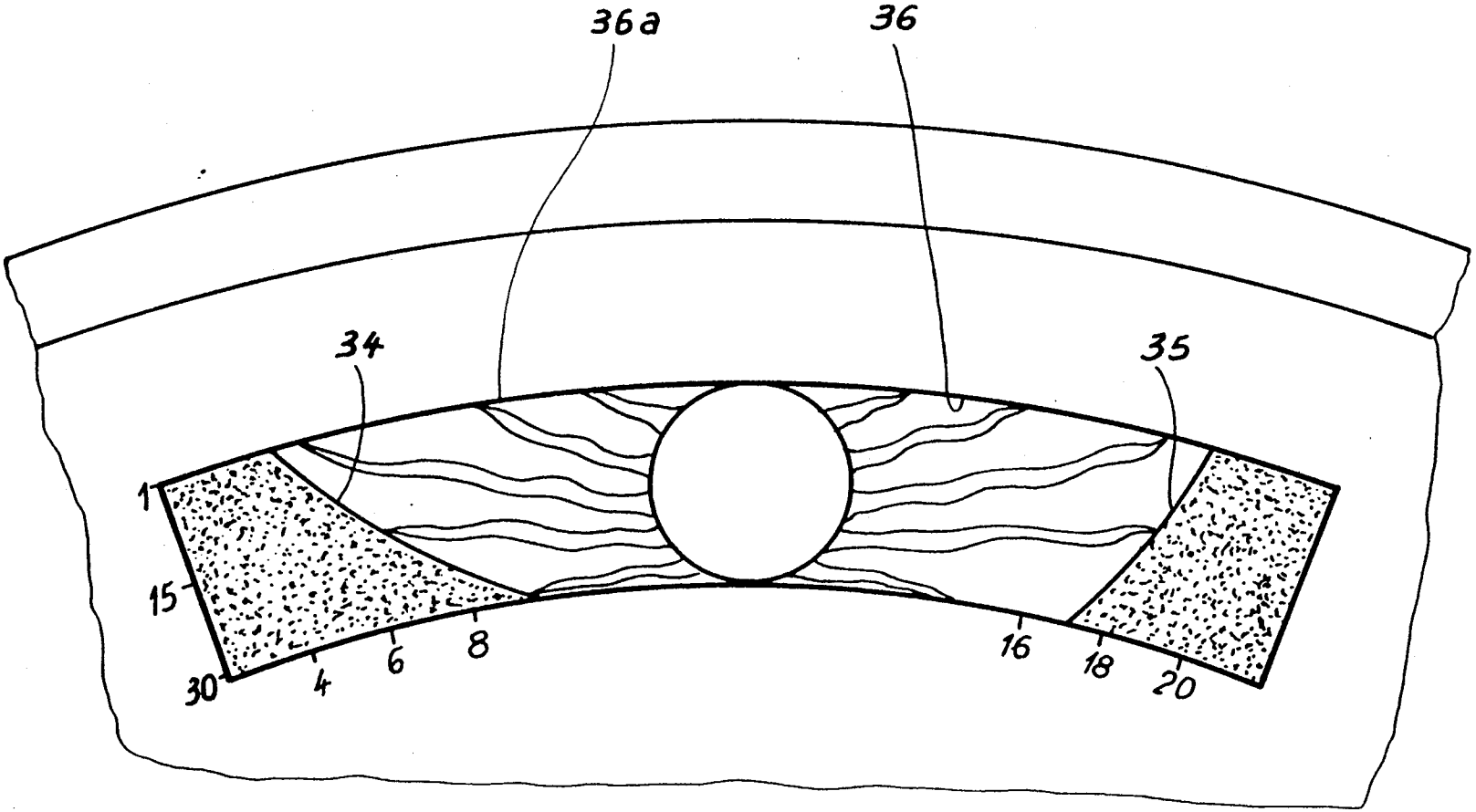

In a variant shown on FIG. 6, one sees two curve segments 34, 35 through the same opening 36. Each of these curve segments represents the daily development of an astronomic magnitude. Here we are concerned with two curve segments representing respectively the time of sunrise and the time of sunset, and the curves are arranged on either side of a schematically represented sun.

It will also be noted that with such an arrangement one may advantageously indicate the variation in the duration of insolation over the course of a given month, for instance by means of a graduated scale (not shown) provided on the upper lateral edge **36*a* of opening 36**.

Figure 7:
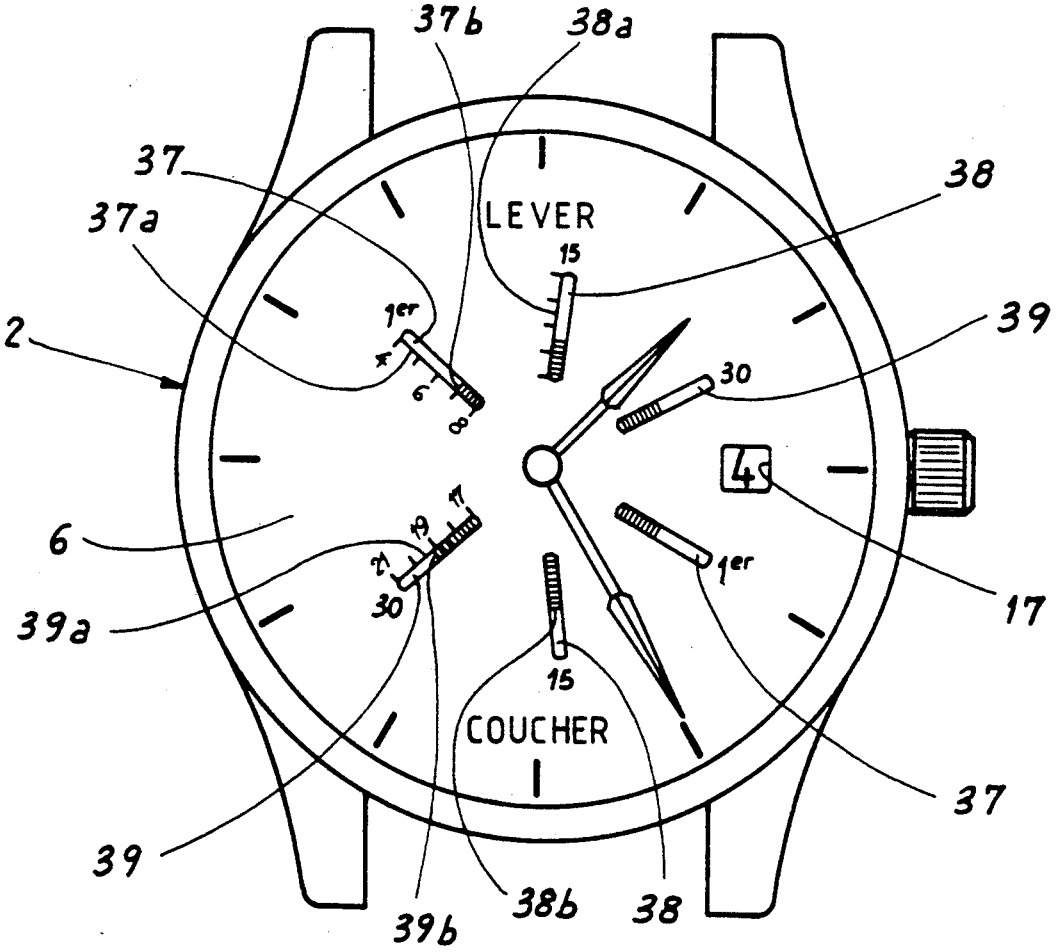
FIG. 7 shows a variant of an embodiment of a dial exhibiting a plurality of openings for the display of an astronomic magnitude according to the invention.

Finally, on FIG. 7 will be seen a variant of timepiece according to the invention, including for astronomic value three openings 37, 38, 39. Each is associated with a predetermined date. In the example shown the first opening 37 is associated with the first day of the month, the second opening 38 is associated with the fifteenth day of the month and the third opening 39 is associated with the thirtieth day of the month. In this example the astronomic magnitudes being the time of sunrise or sunset, the first openings 37 are respectively located at 10 o'clock and 4 o'clock, the second openings 38 at 12 o'clock and 6 o'clock and the third openings 39 at 8 o'clock and 2 o'clock. These openings 37, 38, 39 have an oblong configuration and extend in the radial sense in the middle portion of the dial 6.

Each opening 37, 38, 39 is provided on one of its longitudinal edges 37*a*, 38*a*, 39*a* with a graduated scale enabling the indication of the value of the astronomic magnitude for the date associated with this opening. This value is determined by an index 37*b*, 38*b*, 39*b* visible through these openings, such index being borne on the month disc. This index 37*b*, 38*b*, 39*b* is in fact a curve segment appearing through an opening in a manner such that one may easily interpolate the value of the astronomic magnitude for a date comprised between the first and the fifteenth and the fifteenth and thirty-first day of the month.

As may be well understood, the dial 6 comprises here also an opening 17 (located at 3 o'clock) permitting the appearance of an indication concerning the month, the astronomic information indicated by the index, itself being directly tied thereto.

Figure 2:
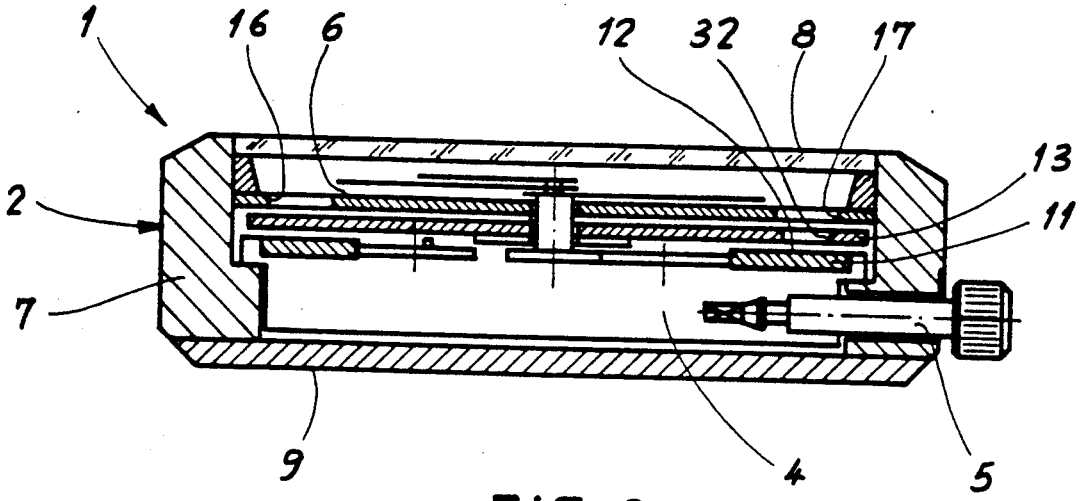
FIG. 2 is a schematic cross-section along line II—II of FIG. 1.
Figure 8:
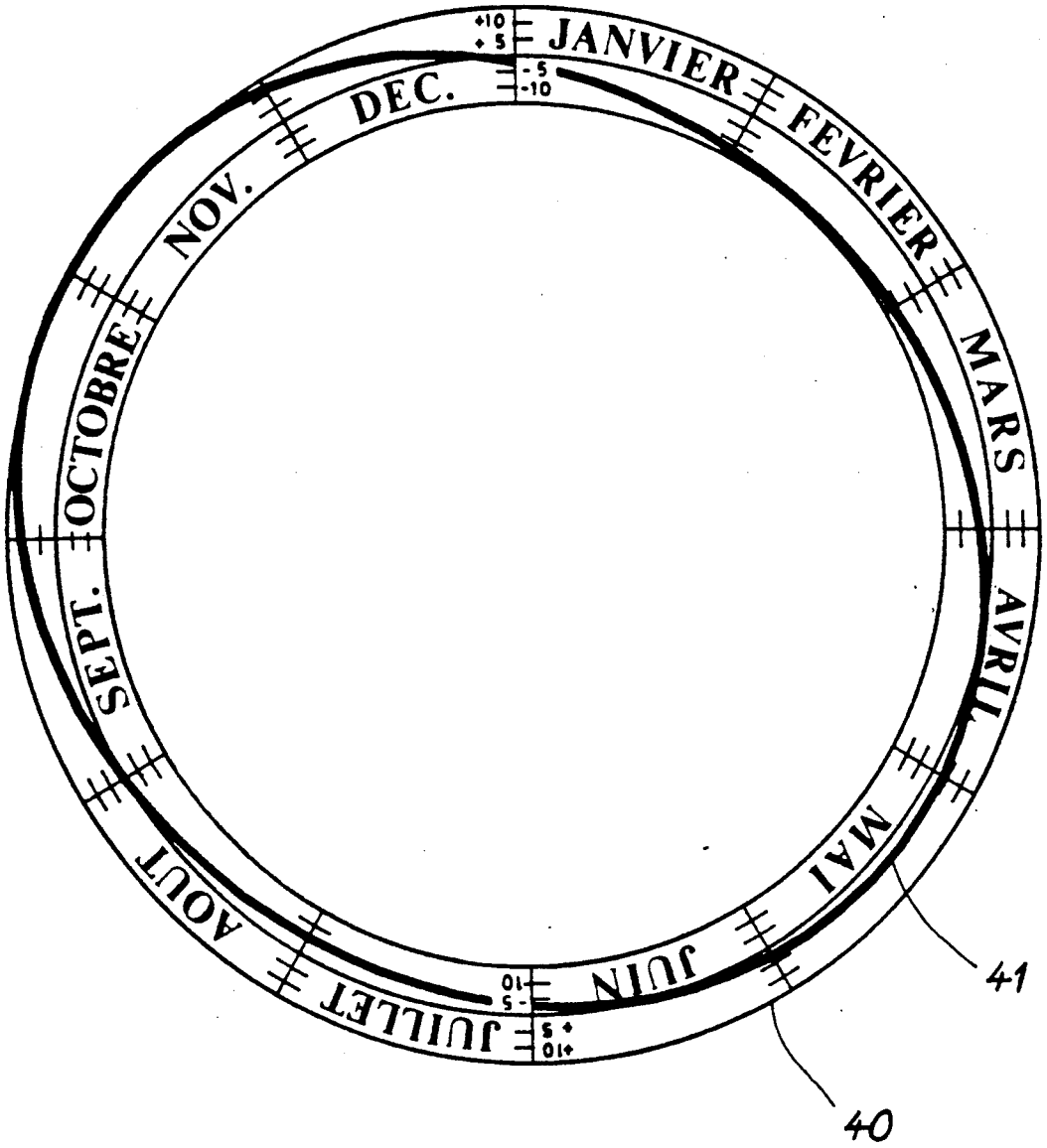
FIG. 8 shows a bezel which may be fitted to a watch in accordance with the invention.

Taking into account the limited surface of the month disc, one may, for easier reading of the astronomic information, carry over the indication of an astronomic magnitude onto a bezel 40 (FIG. 8) which is fixed or rotatably mounted in a well-known manner on the caseband 7 of the case 2 (FIG. 2).

A particularly pleasing appearance may be obtained by having this bezel bear the equation of time as represented by a continuous curve 41.

What I claim is:

1. An astronomic timepiece for indicating at least one astronomic magnitude having an annual cycle varying daily, said timepiece comprising a movement, a first disc bearing a set of curve segments and arranged to be rotated stepwise by said movement so as to effect one revolution per year, a dial provided with at least one opening associated with each astronomic magnitude through each of which a portion of said first disc is visible, first graduations for each opening associated with a date, and a second graduations for each opening associated with the astronomic magnitude said curve segments cooperating with said graduations so as to indicate the daily value of said astronomic magnitude and being arranged in a manner to appear successively in each opening in the course of said rotation of the first disc.

2. A timepiece as set forth in claim 1 comprising a single opening for each astronomic magnitude, each curve segment associated with said opening representing the successive daily values of such astronomic magnitude during one month.

3. A timepiece as set forth in claim 2 wherein the graduations are borne on the dial and arranged along the edges of the opening.

4. A timepiece as set forth in claim 1 comprising a plurality of openings for each astronomic magnitude, each curve segment associated with an opening representing the value of the astronomic magnitude for a predetermined date.

5. A timepiece as set forth in claim 1 wherein said first disc additionally bears an indication for each month of the year and the dial includes an opening to permit reading of the current month.

6. A timepiece as set forth in claim 1 comprising a date disc under the first disc, wherein the dial includes a date opening and wherein the first disc includes a plurality of date openings arranged so that the date appears in the date opening of the dial.

7. A timepiece as set forth in claim 1 wherein at least one of the astronomic magnitudes borne on the first disc is selected from the set of astronomic magnitudes comprising:

the time of sunrise
the time of sunset
the solar declination
the equation of time.

8. A timepiece as set forth in claim 1 wherein said first disc is driven stepwise by said movement at the rate of one step per month.

9. A timepiece as set forth in claim 8 wherein said first disc additionally bears an indication for each month of the year and said dial includes an opening for reading of the current month.

10. A timepiece as set forth in claim 9 further comprising a date disc under said first disc, wherein said dial includes a date opening, and wherein said first disc includes a plurality of date openings arranged between said month indications for reading the current date in said date opening of the dial.

11. A timepiece as set forth in claim 5 further comprising a date disc under said first disc, wherein said dial includes a date opening, and wherein said first disc includes a plurality of date openings arranged between said month indications for reading the current date in said date opening of the dial.

* * * * *